United States Patent [19]

Crookston et al.

[11] 4,352,661

[45] Oct. 5, 1982

[54] SHAFT KILN

[75] Inventors: James A. Crookston; James L. Hill, both of Mexico, Mo.

[73] Assignee: A. P. Green Refractories Co., Mexico, Mo.

[21] Appl. No.: 232,346

[22] Filed: Feb. 6, 1981

[51] Int. Cl.[3] ..... F27B 15/00; F27D 15/02; F27D 1/08

[52] U.S. Cl. ..... 432/14; 432/79; 432/96; 432/99

[58] Field of Search ..... 432/14, 79, 95, 96, 432/99, 101

[56] References Cited

U.S. PATENT DOCUMENTS

| | | | |
|---|---|---|---|
| 1,895,284 | 1/1933 | Hay | 432/99 |
| 2,788,961 | 4/1957 | Pooley et al. | 432/79 |
| 2,948,521 | 8/1960 | Heiligenstaedt | 432/14 |
| 3,142,480 | 7/1964 | Azbe | 432/99 |
| 4,002,422 | 1/1977 | Escott | 432/99 |
| 4,140,480 | 2/1979 | Kaiser et al. | 432/96 |
| 4,248,639 | 2/1981 | Quittkat | 432/14 |

*Primary Examiner*—John J. Camby

*Attorney, Agent, or Firm*—Robert M Didrick; Samuel Kurlandsky; Robert H. Robinson

[57] ABSTRACT

Air heated outside the calcining zone of a shaft kiln is passed through raw material in a hopper mounted above the kiln in order to preheat the raw material. In one embodiment the preheating air is heated by an excess air burner which communicates with the hopper. In another embodiment, the hot calcined material is cooled by forcing cool air through it and the heated air is utilized as preheating air by directing it through a by-pass conduit which connects the cooling zone of the kiln with an extension of the hopper. In neither embodiment does the preheating air constitute combustion supporting air.

14 Claims, 4 Drawing Figures

SHAFT KILN

This invention relates to calcining apparatus, particularly gas fired vertical shaft kilns for burning refractory materials such as alumino-silicates, bauxites, diaspores, flint clays and the like.

Shaft kilns used in the calcining of highly refractory materials such as periclase are designed to achieve maximum fuel efficiency by providing means to preheat both the charge of raw material and the combustion air. This is done after the initial charge has been calcined by forcing air up through the descending burden of hot calcined material, thereby cooling said material and heating the air. The heated air travels further up into the combustion zone or firing section of the kiln where it constitutes the major portion of the air needed to support combustion of the fuel. A very high flame temperature results. Residual heat in the combustion gases is transferred to uncalcined material as the gases continue to travel further upward through the continually descending charge of material.

Uniform temperature conditions are often difficult to maintain, however, because channeling of the air within the bed of material causes the fuel/air ratio to vary from place to place. Overheating of some portions of the material may occur while other portions are underheated and thus not fully calcined. The overheating may be so severe that some materials such as bauxite will fuse into lumps so large that the necessary continuous downward travel of the material is impeded.

Past efforts to modulate the temperature within the calcining zone of the shaft kiln have been directed at the limitation of the temperature which can occur at various levels of said zone by varying the amount of fuel supplied at those levels while continuing to utilize the heat content of air which has traveled upward through already calcined material. A shaft kiln designed for that purpose is described in U.S. Pat. No. 3,142,480.

A large amount of air must be introduced into the cooling zone of the kiln in order to cool the calcined material to a workable temperature. Because there is very little space for expansion within the voids of the descending burden, the pressure increases as the air picks up heat and causes a pressure so great that fluidization of the burden occurs. In addition to maintaining a calcining temperature appropriate to the requirements of a material at a particular stage in the calcining process, therefore, it is also necessary to prevent such a pressure build-up.

Attrition of briquettes or other particles of raw material that are fed into a kiln produces considerable amounts of fines which tend to compact within the bed of material as it descends through the shaft. The compacted fines act as a barrier to the flow of gases in the descending bed and thus cause a pressure rise. Fines clinging to moist briquettes are especially troublesome because they tend to sinter early during the heating process and cause conglomeration of the briquettes. Removal of a substantial portion of the fines before the bed moves into the hotter zones of the shaft is important to the attainment of a steady high rate of production of calcined material.

It is an object of this invention, therefore, to provide a calcining apparatus in the form of a vertical shaft kiln in which localized overheating and underheating are avoided.

It is another object of this invention to provide such a shaft kiln in which the fusing of relatively low melting refractories is prevented.

It is another object of this invention to provide a shaft kiln in which a substantial portion of fines are removed from the descending bed of material before the bed reaches the calcination zone of the kiln.

It is another object of this invention to provide a shaft kiln in which the charge of materials to be calcined is preheated without increasing the pressure within the calcining zone of the kiln.

It is a further object of this invention to provide a shaft kiln in which calcined material is cooled before discharge by air flowing perpendicularly to and either concurrently with or countercurrently to the descending burden of such material.

It is a still further object of this invention to provide a fuel-efficient method for calcining a refractory material in which heat is transferred from hot calcined material to incoming material while the calcining temperature and pressure are regulated solely by adjusting the amounts of fuel and air being burned.

These and other objects which will become apparent from the following specification and the appended drawings are achieved by an apparatus and a method in which air heated outside of the calcining zone of the shaft kiln is used to preheat the raw material before said material descends into the calcining zone, said preheating air is vented to the atmosphere, a stoichiometric or leaner mixture of fuel and air is burned within the calcining zone, and the descending burden of calcined material is cooled before discharge from the kiln by a stream of air.

In one embodiment of the invention the heat content of the preheating air is provided by an excess air burner preferably located near the top of the verticl shaft so that the burner's exhaust gases may be directed into a hopper from which the raw material is fed into the kiln. A preferred embodiment of the invention does not require a secondary source of heat; the heat used to preheat the material is that which is recuperated from the hot calcined material by the cooling air introduced into the kiln below the calcining zone.

Figure 1:
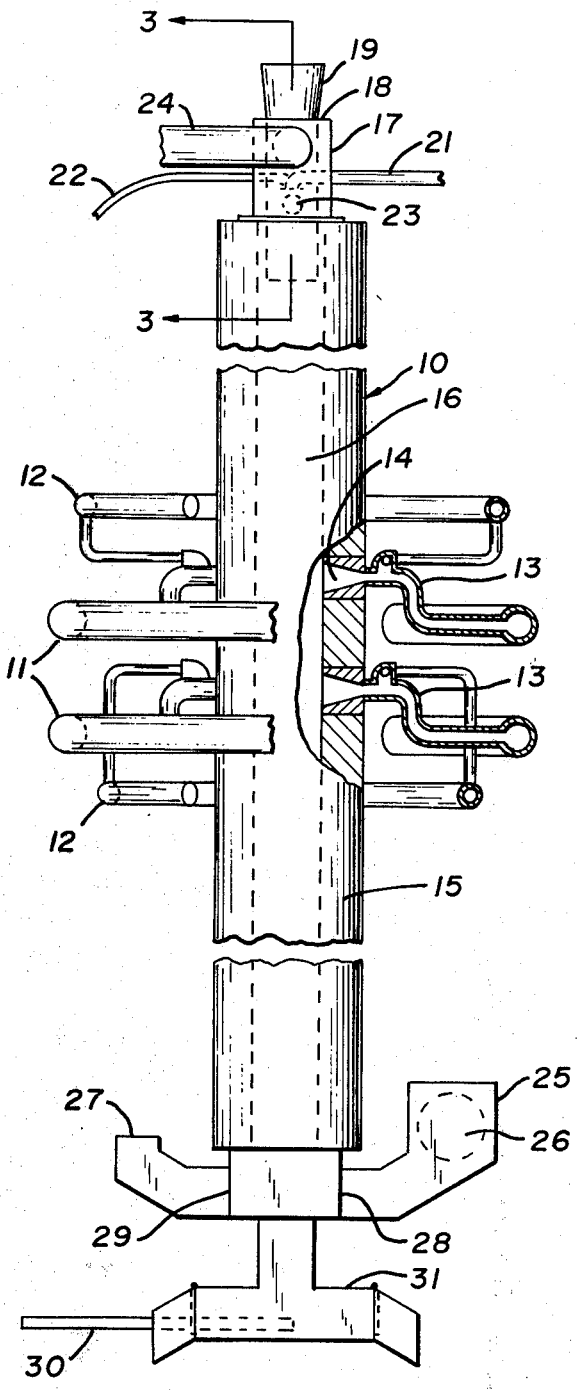
FIG. 1 is a front elevational view, partially broken away, of one embodiment of the shaft kiln of this invention.
Figure 2:
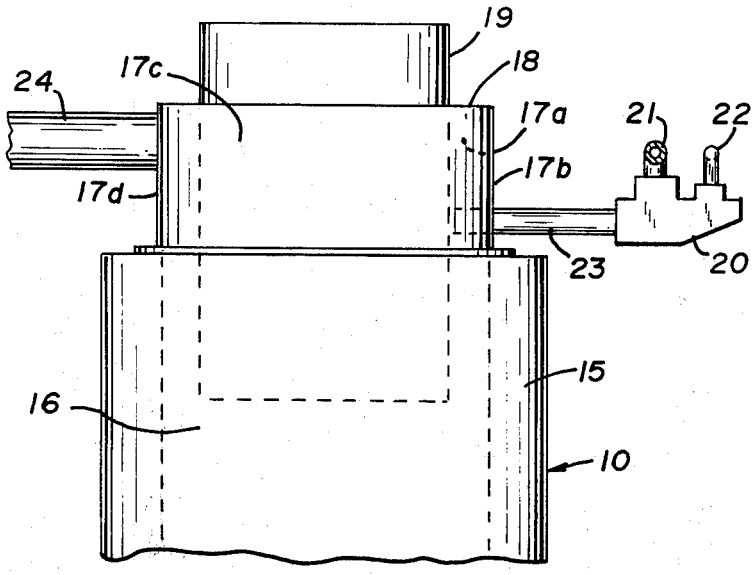
FIG. 2 is a side elevational view of the upper portion, of the apparatus shown in FIG. 1.
Figure 3:
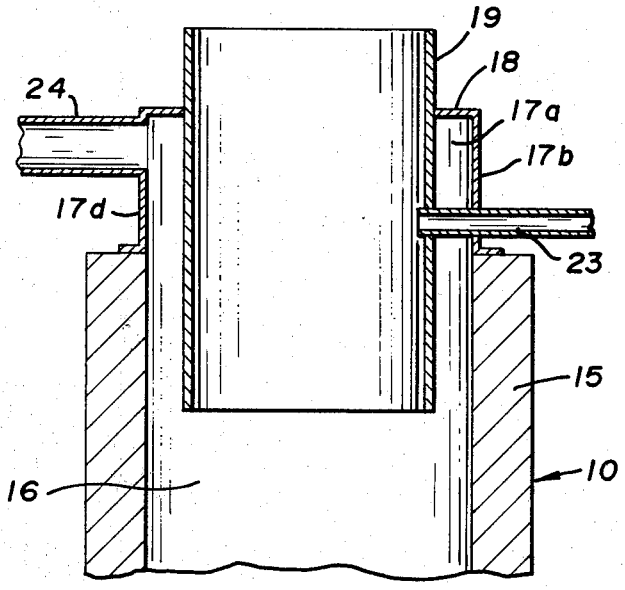
FIG. 3 is a sectional view of the portion of the apparatus shown in FIG. 2, taken along the line 3—3 in FIG. 1.

In FIG. 1, the shaft kiln 10 is equipped with air bustles 11 and gas bustles 12 which communicate with a plurality of burners 13 and burner blocks 14 fixed within the wall 15. At the upper end of the kiln 10, the shaft 16 is closed off by a vestibule 17 having side plates **17*a*, 17*b*, 17*c*, 17*d* and a top plate 18, through which a hopper 19 extends. An excess air burner 20, mounted at the rear of the vestibule 17 (as shown in FIG. 2) is connected to an air supply and a fuel gas supply by pipes 21 and 22, respectively. The excess air burner 20 communicates with the hopper 19 through a pipe 23. An exhaust duct 24 extends through the side plate 17*d* to connect the space between the hopper 19 and the vestibule 17 with accessory equipment (not shown) for the removal and separation of gases and fines. Said equipment includes a cyclone unit and an exhaust stack in which a fan is mounted. At the bottom of the kiln 10, a cooling plenum 25 having an inlet 26 and an outlet 27 communicates with the shaft 16 through ports 28 and 29. A blower (not shown) is mounted to the inlet 26. A drag bar 30 is slidably mounted within the catch-box 31**.

Figure 4:
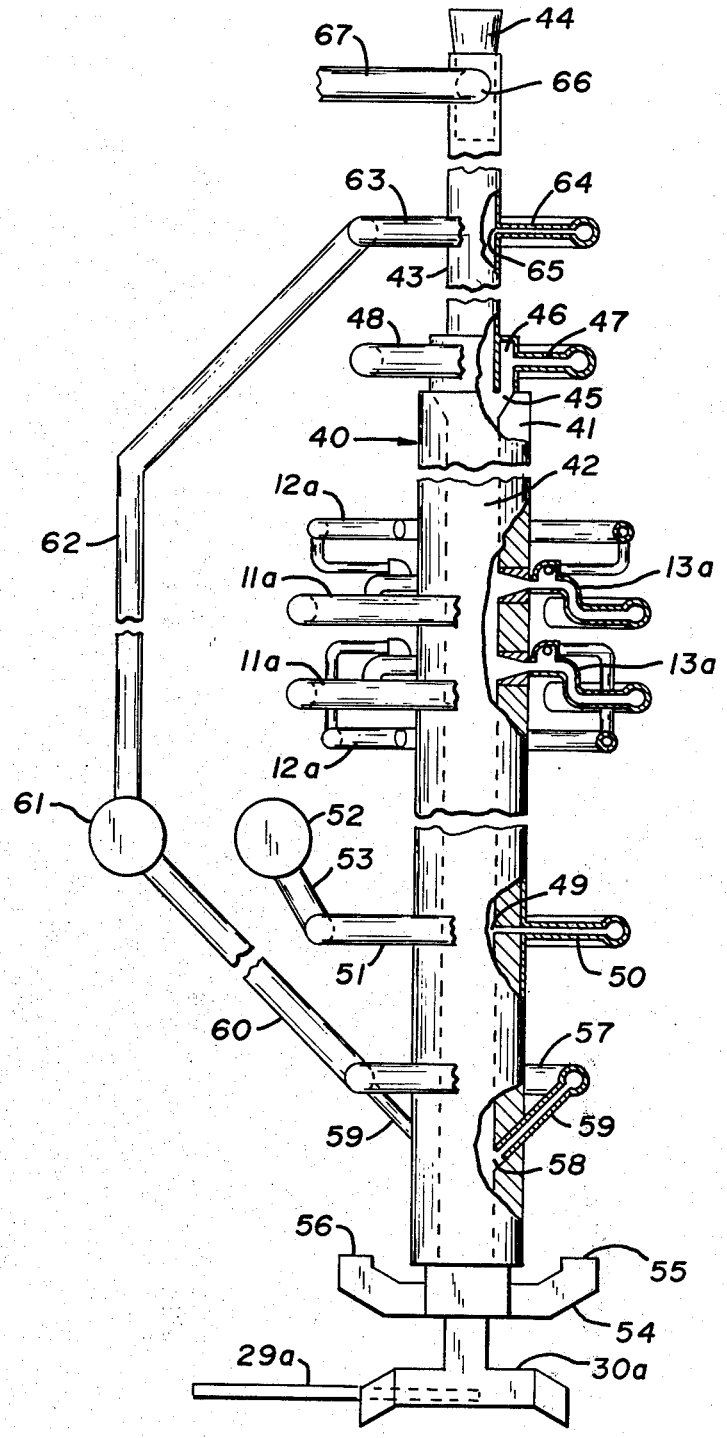
FIG. 4 is a front elevational view of a preferred embodiment of this invention.

In FIG. 4, a shaft kiln 40 is equipped with air bustles 11*a* and gas bustles 12*a* which communicate with a plurality of burners 13*a* fixed within a wall 41. The shaft 42 diverges radially outward at its uppermost extremity to receive an extension 43 of the hopper 44 and thereby provide a toroidal exit port 45 for combustion gases and, as will be apparent later, a portion of the spent preheating air. Said exit port 45 communicates with an exhaust chamber 46 which is connected by a plurality of pipes 47 to an exhaust bustle 48. Said exhaust bustle 48 is connected to a cyclone or other gas/solids separator (not shown). A plurality of tuyeres 49, mounted in the wall 41 and spaced apart around the interior perimeter of said wall, are connected by the tubes 50 to a cooling air bustle 51 which, in turn, is connected to a blower housing 52 by a conduit 53. A cooling air plenum 54 having an inlet 55 and an inlet 56 communicates with the shaft 42. A hot air exhaust bustle 57 communicates with the shaft 42 through a plurality of exit ports 58 and conduits 59. A bypass conduit 60 is connected to the exhaust bustle 57 at one end and to a fan housing 61 (fan not shown) at the other end. Another by-pass conduit 62 connects housing 61 and a preheating air bustle 63 which communicates with the hopper extension 43 through a plurality of conduits 64 and ports 65 spaced apart around the perimeter of the extension 43. Preheating air exhaust outlet 66 in the wall of the extension 43 is connected by a duct 67 to a cyclone (not shown) which may be the same as that associated with the exhaust bustle 48 or may be an additional one. A drag bar 29*a* is slidably mounted within a catch-box 30*a* at the base of the shaft kiln 40.

As an example of the operation of the shaft kiln 10, bauxite briquettes measuring $1\frac{1}{4}'' \times \frac{3}{4}'' \times \frac{1}{2}''$ (32 mm×19 mm×13 mm) and containing about 30% by weight of mechanically bound water and 25% by weight of chemically bound water are partially dried and preheated by hot gases being blown out of the excess air burner 20 (burning a 70:1 air/gas mixture) as the briquettes descend through the hopper 19 into the shaft 16. The temperature of the preheating air is 700°–800° F. (370°–425° C.) and the heat input from this source is 300,000 BTU per hour (about 75,600 kg. cal. per hour). The shaft 16 is 3'×1' (0.9×0.3 meter) in cross-section, 20' (6.1 meters) long, and is encircled by two rings of burners 13, each ring consisting of ten burners. A lean mixture of air and natural gas (about 11 volumes of air per volume of gas) is burned in the burner blocks 14 generating 2,300,000 BUT per hour (580,000 kg. cal. per hour) to maintain a temperature of 3000° F. (1650° C.) within the calcining zone of the shaft 16. The volumes of air and gas fed into each burner 13 are regulated by pressure gauges. Hot combustion gases rising up the shaft 16 heat the preheated briquettes further before they reach the calcining zone. The moisture laden preheating air and the spent combustion gases are vented from the system through the space between the hopper 19 and the vestibule 17 and are drawn through exhaust duct 24 and a cyclone separator by a fan in an exhaust stack. The maximum pressure within the shaft 16 is 10" $H_2O$ (2.5 kPa) and this occurs in a zone which is midway between the two rings of burners. Above that zone the pressure drops precipitously within about 5 feet (1.5 meters) to less than 1" $H_2O$. Below that zone the pressure drops less quickly to about 5" $H_2O$ (1.25 kPa) near the bottom of the shaft 16. After having descended through the calcining zone, the hot material passes through a cooling zone into which air is blown from outside kiln 10 through inlet 26, plenum 25 and port 28. Said cooling air is forced to flow perpendiculary into the descending bed of material and then out of the system through the outlet 27. The cooled granular product is discharged into the catch-box 31 at the rate of 0.4 ton (about 360 kg.) per hour and is removed by the drag bar 30. The grain density is 2.87 g./cc., the grain size is 96% +4 mesh, and the $Al_2O_3$ content is 70%.

In the operation of the shaft kiln 40 of FIG. 4, cooling air is blown into the shaft 42 through the tuyeres 49 to flow concurrently with the hot calcined material and is drawn through the plenum 54 to flow countercurrently through the cooler material. The heated air then is drawn into the conduit 60 and blown through the conduit 62 and the bustle 63 to enter the hopper extension 43 through the ports 65 to act as preheating air. Wet briquettes descending through the extension 43 are dried and lightly calcined by the heated air, a portion of which flows upward to be vented through the outlet 66 while the remainder flows concurrently with the briquettes and is drawn into the bustle 48, along with spent combustion gases from the calcining zone. At a fuel input of 3,000,000 BTU's per hour, an air/gas ratio of 11:1 by volume and a product discharge rate of 0.75 ton per hour, the burning zone temperature will be 3000° F. At a cooling air input rate totaling 1000 CFM at 70° F. (472 liters/sec. at 21° C.), the maximum pressure within the shaft 42 will be 10" $H_2O$ and this will occur in a zone extending from midway between the two rings of burners 13*a* down to the level of the bustle 51.

For the calcination of relatively low melting refractory materials such as alumino-silicates, bauxites, diaspores, and flint clays, the burning zone is maintained at a temperature within the range of from about 2000° F. to about 3400° F. To obtain such temperatures, mixtures of air and natural gas at volumetric ratios ranging from the stoichiometric 9.7:1 to about 20:1 may be used. When gaseous fuels other than natural gas are used, the air/gas ratio which is required to obtain a specified temperature will be different but it always will be stoichiometric or leaner.

When the excess air burner 20 is used in the preheating step of this invention, the volumetric ratio of air to gas in the mixture being burned may range from about 40:1 to about 150:1. Thus, air constitutes substantially all of the preheating gas generated by such a burner in the method of this invention.

The production rates given in the above illustrations obviously are too small for commercial feasibility. Production rates of 6 tons per hour at a fuel consumption rate of from about 3 to about 4 million BTU's per ton of product are possible in a scaled-up kiln utilizing the hot cooling air to dry and preheat the charge of raw material in shaft kiln 40.

The above description and exemplification of two embodiments of the invention are illustrative only. Different embodiments and other variations of the apparatus and process may occur to those skilled in the art but still be within the scope of the invention as claimed.

What is claimed is:

1. A calcining apparatus comprising an upright hollow shaft having a side wall and top wall and adapted to the passage downward of particulate material from a hopper mounted in said top wall through a preheating zone of said shaft, a calcining zone of said shaft, a cooling zone of said shaft, and a discharge port, in sequence, said apparatus further comprising:

a means for forming and proportioning a fuel/air mixture, a means for burning said mixture and introducing the resulting combustion product gases into the calcining zone, and a means coaxial with the shaft and disposed above the calcining zone for removing spent combustion product gases from the shaft;

a duct extending from said hopper through said top wall into said shaft and forming at least a part of the preheating zone, said duct having a preheating air inlet;

a means, extrinsic to said burning means, for heating air, a means for blowing the heated air into said duct through said preheating air inlet, and a means for exhausting spent preheating air from the preheating zone;

a means for forcing cooling air into the cooling zone, said forcing means having an inlet end open to the atmosphere and an outlet end which penetrates the side wall of the shaft below the calcining zone; and a means for purging hot air from the cooling zone;

whereby, during the passage of particulate material through the shaft, the material is at least partially dried by hot air in said hopper extension and the calcined material is cooled while the pressure and temperature within the calcining zone are regulated solely by the fuel/air proportioning means.

2. The apparatus of claim 1 wherein the means for heating the air comprises an excess air burner connected to the preheating air inlet of said hopper duct.

3. A calcining apparatus comprising an upright hollow shaft having a side wall and a top wall and adapted to the passage downward of particulate material from a hopper mounted above said top wall through a preheating zone of said shaft, a calcining zone of said shaft, a cooling zone of said shaft, and a discharge port, in sequence, said apparatus further comprising:

a duct extending from said hopper through said top wall into said shaft, said duct having a preheating air inlet;

a means for forming and proportioning a fuel/air mixture, a means for burning said mixture and introducing the combustion product gases into the calcining zone, and a means coaxial with the shaft and disposed between the preheating air inlet and the calcining zone for removing spent combustion product gases;

a conduit connecting the preheating air inlet of said duct with the cooling zone and by-passing the fuel/air burning means;

a means for injecting cooling air into the cooling zone, said injection means having an inlet end communicating with a source of cooling air and an outlet end which penetrates the side wall of said shaft below the calcining zone;

a cooling zone purging means connected to said by-pass conduit; and a means for venting spent preheating air from the preheating zone of said shaft, whereby heat from calcined material traveling downward in said shaft is transferred to air flowing through the cooling zone and is transmitted to incoming particulate material in the extended duct of the hopper and the pressure and temperature within the calcining zone is regulated solely by the fuel/air proportioning means.

4. The apparatus of claim 3 wherein the cooling air injection means comprises a bustle surrounding said shaft, a plurality of tubes connecting said bustle and the cooling zone of said shaft and a blower means associated with said bustles.

5. The apparatus of claim 3 wherein the cooling zone purging means is connected to said zone in a plane below the plane in which the outlet end of the injection means penetrates the side wall of the shaft, whereby the flow of cooling air within the shaft is concurrent with the downward movement of the calcined material.

6. A method for calcining a solid particulate material which comprises introducing the material into a hopper, causing the material to flow by force of gravity into the upper end of a vertical shaft kiln and down through the kiln, heating a stream of gas consisting substantially entirely of air and passing said gas stream through the material as it flows through the hopper to preheat the material, and drawing said gas stream out of the material before the material reaches the calcining temperatures; forming a calcining mixture of air and a gaseous fuel having a volumetric air to fuel ratio of from 9.7:1 to about 20:1, burning said mixture, introducing the hot combustion product gases into the preheated material, and passing said gases continuously upward through the descending material to heat the material to the calcining temperature, drawing the spent calcining gases out of the material and venting said spent gases to the atmosphere; and passing a stream of air through the calcined material to cool said material, drawing the thus heated cooling air out of the cooled material and directing the hot air away from the burning fuel/air mixture.

7. The method of claim 6 wherein the particulate material is preheated by passing the heated cooling air through it.

8. The method of claim 7 characterized further by venting the heated cooling air to the atmosphere after it has passed through the incoming particulate material.

9. The method of claim 6 wherein the particulate material is preheated by burning a fuel in the presence of a large excess of air and passing the resulting stream of gas through the material.

10. The method of claim 9 wherein the heated cooling air is vented to the atmosphere after being drawn out of the kiln.

11. A calcining apparatus comprising an upright hollow shaft having a side wall and a top wall and adapted to the passage downward through said shaft of material from a hopper mounted above said top wall, said apparatus further comprising:

a duct extending from said hopper through said top wall and having a preheating air inlet, said duct and the adjacent zone of the shaft forming a preheating zone within the apparatus;

a means for forming and proportioning a fuel/air mixture, a means for burning said mixture and introducing the resulting combustion product gases into a calcining zone of the shaft which is below the preheating zone, and a means coaxial with the shaft and disposed above said calcining zone for removing spent combustion gases from said calcining zone;

a means, extrinsic to said burning means, for heating air, a means for blowing the heated air into said duct through said preheating air inlet, and a means for exhausting spent preheating air from the preheating zone;

a means for forcing cooling air into a zone of the shaft which is below the calcining zone; and a means for purging said cooling air from the cooling zone of the shaft after said air has absorbed heat from the calcined material;

whereby, during the passage of the material through the shaft, the material is at least partially dried by hot air in said duct and the calcined material is cooled while the pressure and temperature within the calcining zone are regulated solely by the fuel/air proportioning means.

12. The apparatus of claim 11 wherein the purging means includes a means for directing the heated air into a heat absorbing medium effective to prevent the use of the heated air while hot as a combustion support.

13. A calcining apparatus comprising an upright hollow shaft having a side wall and a top wall and adapted to the passage downward of material through said shaft from a hopper mounted above said top wall, said apparatus further comprising:

a duct extending from said hopper though said top wall and having a prehating air inlet, said duct and the adjacent zone of said shaft forming a preheating zone within the apparatus;

a means for forming and proportioning a fuel/air mixture, a means for burning said mixture and introducing the combustion product gases into a calcining zone of the shaft which is below the preheating zone;

a means coaxial with the shaft and intermediate the preheating air inlet and the calcining zone for removing spent combustion product gases;

a means for injecting cooling air into the shaft, which means has an inlet end which communicates with a source of cooling air and an outlet end which penetrates the side wall of the shaft below the calcining zone;

a conduit connecting the preheating air inlet of said duct with the cooling zone and by-passing the fuel/air burning means;

a cooling zone purging means connected to said by-pass conduit; and a means for venting spent preheating air from the preheating zone of the apparatus;

whereby heat from calcined material traveling downward in said shaft is transferred to air flowing through the cooling zone and is transmitted to incoming material in said duct and the pressure and temperature within the calcining zone is regulated solely by the fuel/air proportioning means.

14. The apparatus of claim 1 wherein the hot air purging means includes a means for directing said hot air into a heat absorbing medium effective to prevent the use of said hot air as a combustion support.

* * * * *